US012716595B2

(12) United States Patent
Wu et al.

(10) Patent No.: US 12,716,595 B2
(45) Date of Patent: Aug. 25, 2026

(54) HEAT EXCHANGER SEALING PLATE FOR AIR CONDITIONER, INDOOR UNIT AND AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Lin Wu, Foshan (CN); Yongqian Lin, Foshan (CN); Yang Xi, Foshan (CN); Baisong Zhou, Foshan (CN); Lichao Wen, Foshan (CN); Zhengbo Feng, Foshan (CN); Yong Gu, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 390 days.

(21) Appl. No.: 18/564,004

(22) PCT Filed: Apr. 6, 2022

(86) PCT No.: PCT/CN2022/085425
§ 371 (c)(1),
(2) Date: Nov. 24, 2023

(87) PCT Pub. No.: WO2023/050758
PCT Pub. Date: Apr. 6, 2023

(65) Prior Publication Data

US 2024/0255158 A1 Aug. 1, 2024

(30) Foreign Application Priority Data

Sep. 30, 2021 (CN) ..... 202111161900.0

(51) Int. Cl.
*F24F 1/0063* (2019.01)
*F24F 11/89* (2018.01)

(52) U.S. Cl.
CPC ..... *F24F 1/0063* (2019.02); *F24F 11/89* (2018.01)

(58) Field of Classification Search
CPC ..... F24F 1/0063; F24F 13/222; F24F 13/32; F28F 2230/00; F28F 9/002
(Continued)

(56) References Cited

FOREIGN PATENT DOCUMENTS

CN 1151498 A * 6/1997 ..... F24F 1/0063
CN 102818345 A 12/2012
(Continued)

OTHER PUBLICATIONS

Extended European Search Report dated Dec. 12, 2024 for European Patent Application No. 22874159.1.
(Continued)

*Primary Examiner* — Steve S Tanenbaum
(74) *Attorney, Agent, or Firm* — SCULLY, SCOTT, MURPHY & PRESSER, P.C.

(57) ABSTRACT

A heat exchanger sealing plate for an air conditioner, an indoor unit and an air conditioner are provided. The indoor unit includes a casing, an air guiding ring, a heat exchanger, a sealing plate and a water pump. The air guiding ring is provided in the casing. The heat exchanger has a first end and a second end, and the heat exchanger is provided in the casing and surrounds the air guiding ring. The sealing plate is provided in the casing, the sealing plate has a first connecting portion, a second connecting portion and a water pump mounting portion. The first connecting portion and the second connecting portion are connected to the heat exchanger, in order for the sealing plate to close a gap between the first end and the second end of the heat
(Continued)

exchanger. The water pump is mounted on the water pump mounting portion.

24 Claims, 3 Drawing Sheets

(58) Field of Classification Search
USPC ..... 165/53
See application file for complete search history.

(56) References Cited

FOREIGN PATENT DOCUMENTS

| | | | | | |
|---|---|---|---|---|---|
| CN | 205425333 | U | | 8/2016 | |
| CN | 107477685 | A | | 12/2017 | |
| CN | 108826466 | A | | 11/2018 | |
| CN | 208579393 | U | | 3/2019 | |
| CN | 210717828 | U | | 6/2020 | |
| CN | 211551827 | U | | 9/2020 | |
| CN | 213362678 | U | * | 6/2021 | |
| CN | 113405253 | A | * | 9/2021 | ..... F24F 11/89 |
| CN | 113739262 | A | | 12/2021 | |
| JP | H0949640 | A | | 2/1997 | |
| JP | 2002013756 | A | | 1/2002 | |
| JP | 2009180386 | A | | 8/2009 | |
| JP | 2009236422 | A | | 10/2009 | |
| WO | 2013047240 | A1 | | 4/2013 | |
| WO | WO-2017006467 | A1 | * | 1/2017 | ..... F24F 1/0022 |

OTHER PUBLICATIONS

International Search Report and Written Opinion dated Jul. 6, 2022 issued in PCT/CN2022/085425.
CN First Office Action dated Jul. 11, 2022 issued in CN 202111161900.0.

* cited by examiner

HEAT EXCHANGER SEALING PLATE FOR AIR CONDITIONER, INDOOR UNIT AND AIR CONDITIONER

CROSS-REFERENCE TO RELATED APPLICATION APPLICATIONS

This application is a National Stage Entry under 35 U.S.C. § 371 of PCT International Application No. PCT/CN2022/085425, filed on Apr. 6, 2022, which claims priority to and benefits of Chinese Patent Application Serial No. 202111161900.0, filed on Sep. 30, 2021, the entire contents of each of which are incorporated herein by reference.

FIELD

The present disclosure relates to the field of air conditioners, and more particularly to a heat exchanger sealing plate for an air conditioner, an indoor unit and an air conditioner.

BACKGROUND

In recent years, air conditioners have a tendency toward structural compactness, simplicity and high efficiency. However, indoor units such as embedded air conditioning indoor units have many types of functional components and complex spatial layout and routing, and each functional component is usually mounted with a separate installation structure, which further increases structural complexity, requires more installation space, and leads to poor convenience of disassembly and assembly.

SUMMARY

The present disclosure aims to solve at least one of the problems existing in the related art to at least some extent.

Accordingly, embodiments of the present disclosure provide an indoor unit that can realize rapid anomaly check and troubleshooting, thus improving the anomaly handling efficiency.

Embodiments of the present disclosure also provide an air conditioner using the indoor unit.

Embodiments of the present disclosure also provide a sealing plate applied to the indoor unit and the air conditioner.

An indoor unit according to embodiments of the present disclosure includes: a casing; an air guiding ring arranged inside the casing; a heat exchanger having a first end and a second end, the heat exchanger being arranged inside the casing and surrounding the air guiding ring; a sealing plate arranged inside the casing and having a first connecting portion, a second connecting portion and a water pump mounting portion, the first connecting portion and the second connecting portion being connected with the heat exchanger to allow the sealing plate to seal a gap between the first end and the second end of the heat exchanger; and a water pump mounted on the water pump mounting portion.

For the indoor unit according to embodiments of the present disclosure, the indoor unit can realize rapid anomaly check and troubleshooting, and improve the anomaly handling efficiency.

In some embodiments, the indoor unit further includes a water level switch, the sealing plate has a water level switch mounting portion, and the water level switch is mounted on the water level switch mounting portion.

In some embodiments, the sealing plate has a wire hole, and at least one of wires for a motor of the water pump, for the water level switch, and for a motor of the fan wheel is led to outside of the casing through the wire hole.

In some embodiments, the indoor unit further includes a chassis, the sealing plate also has a chassis fixing portion, and the chassis is connected to the chassis fixing portion.

In some embodiments, the sealing plate includes a first plate body and a second plate body, the second plate body being roughly L-shaped; a second longitudinal edge of the first plate body is connected with a first longitudinal edge of the second plate body; the water pump mounting portion is on an outer surface of the first plate body deviating from the air guiding ring, and the water level switch is on an outer surface of the second plate body deviating from the air guiding ring.

In some embodiments, the first connecting portion is on a first longitudinal edge of the first plate body and adjacent to a first end of the first plate body, and the first connecting portion is connected to the first end of the heat exchanger; the second connecting portion is on the first longitudinal edge of the second plate body and adjacent to a first end of the second plate body, and the second connecting portion is connected to the second end of the heat exchanger; the wire hole is at a second end of the first plate body, and the chassis fixing portion is at the second end of the first plate body.

In some embodiments, the chassis fixing portion includes a first chassis fixing portion and a second chassis fixing portion, and the wire hole is between the first chassis fixing portion and the second chassis fixing portion.

In some embodiments, the wire hole is a groove with an opening and is at the second end of the first plate body; the first chassis fixing portion is formed as an extension plate, the extension plate being on an inner surface of the first plate body and having a first fixing hole, and the second chassis fixing portion is formed as a lug, the lug being on the inner surface of the first plate body and having a second fixing hole; the first connecting portion has a first connecting hole, and the second connecting portion has a second connecting hole, a thickness of the first connecting portion being greater than a thickness of the first plate body, and a thickness of the second connecting portion being greater than the thickness of a second plate body.

In some embodiments, the water pump mounting portion is formed as a water pump mounting plate, and the water pump mounting plate is a roughly U-shaped with an opening facing towards a first end of the first plate body; an open end of the water pump mounting plate is provided with a first lug plate extending from a first side wall of the water pump mounting plate towards a first longitudinal edge of the first plate body and is provided with a second lug plate extending from a second side wall of the water pump mounting plate towards the second longitudinal edge of the first plate body; the first lug plate has a third connecting hole, and the second lug plate has a fourth connecting hole.

In some embodiments, a part of the first end of the first plate body protrudes inward to form a protruding portion on an inner surface of the first plate body and form a step surface on the outer surface of the first plate body, the protruding portion is arc-shaped, and the water pump mounting portion is between the protruding portion and a second end of the first plate body.

In some embodiments, the water level switch mounting portion is formed as a water level switch hole and a water level switch mounting plate, the water level switch mounting plate is arranged on a hole edge of the water level switch hole, and the water level switch mounting plate is L-shaped and extends from an inner surface of the second plate body.

In some embodiments, a first longitudinal edge of the first plate body is formed as a flat plate abutting against the heat exchanger, and the first longitudinal edge of the second plate body is formed as a flat plate abutting against the heat exchanger.

In some embodiments, the casing has a roughly rectangular cross section, and the sealing plate is at a corner inside the casing.

An air conditioner according to embodiments of the present disclosure includes the indoor unit in any one of the above embodiments.

A sealing plate for a heat exchanger of an air conditioner according to embodiments of the present disclosure includes a first connecting portion for connection with the heat exchanger, a second connecting portion for connection with the heat exchanger, and a water pump mounting portion for installation of a water pump.

In some embodiments, the sealing plate further includes a water level switch mounting portion for installation of a water level switch.

In some embodiments, the sealing plate further has a wire hole to allow at least one of wires for a motor of the water pump, for the water level switch, and for a motor of the fan wheel to pass through.

In some embodiments, the sealing plate further includes a chassis fixing portion for fixation of a chassis.

In some embodiments, the sealing plate includes a first plate body and a second plate body, the second plate body being roughly L-shaped; a second longitudinal edge of the first plate body is connected with a first longitudinal edge of the second plate body; the water pump mounting portion is on an outer surface of the first plate body deviating from an air guiding ring, and the water level switch is on an outer surface of the second plate body deviating from the air guiding ring; the first connecting portion is on a first longitudinal edge of the first plate body and adjacent to a first end of the first plate body, and the first connecting portion is connected to the first end of the heat exchanger; the second connecting portion is on the first longitudinal edge of the second plate body and adjacent to a first end of the second plate body, and the second connecting portion is connected to the second end of the heat exchanger; the wire hole is at a second end of the first plate body, and the chassis fixing portion is at the second end of the first plate body.

In some embodiments, the chassis fixing portion includes a first chassis fixing portion and a second chassis fixing portion, and the wire hole is between the first chassis fixing portion and the second chassis fixing portion.

In some embodiments, the wire hole is a groove with an opening and is at the second end of the first plate body; the first chassis fixing portion is formed as an extension plate, the extension plate being on an inner surface of the first plate body and having a first fixing hole, and the second chassis fixing portion is formed as a lug, the lug being on the inner surface of the first plate body and having a second fixing hole; the first connecting portion has a first connecting hole, and the second connecting portion has a second connecting hole, a thickness of the first connecting portion being greater than a thickness of the first plate body, and a thickness of the second connecting portion being greater than the thickness of a second plate body.

In some embodiments, the water pump mounting portion is formed as a water pump mounting plate, and the water pump mounting plate is a roughly U-shaped with an opening facing towards a first end of the first plate body; an open end of the water pump mounting plate is provided with a first lug plate extending from a first side wall of the water pump mounting plate towards the first longitudinal edge of the first plate body and is provided with a second lug plate extending from a second side wall of the water pump mounting plate towards the second longitudinal edge of the first plate body; the first lug plate has a third connecting hole, and the second lug plate has a fourth connecting hole.

In some embodiments, a part of the first end of the first plate body protrudes inward to form a protruding portion on an inner surface of the first plate body and form a step surface on the outer surface of the first plate body, the protruding portion is arc-shaped, and the water pump mounting portion is between the protruding portion and a second end of the first plate body; the water level switch mounting portion is formed as a water level switch hole and a water level switch mounting plate, the water level switch mounting plate is arranged on a hole edge of the water level switch hole, and the water level switch mounting plate is L-shaped and extends from an inner surface of the second plate body.

In some embodiments, the first longitudinal edge of the first plate body is formed as a flat plate abutting against the heat exchanger, and the first longitudinal edge of the second plate body is formed as a flat plate abutting against the heat exchanger.

Figure 1:
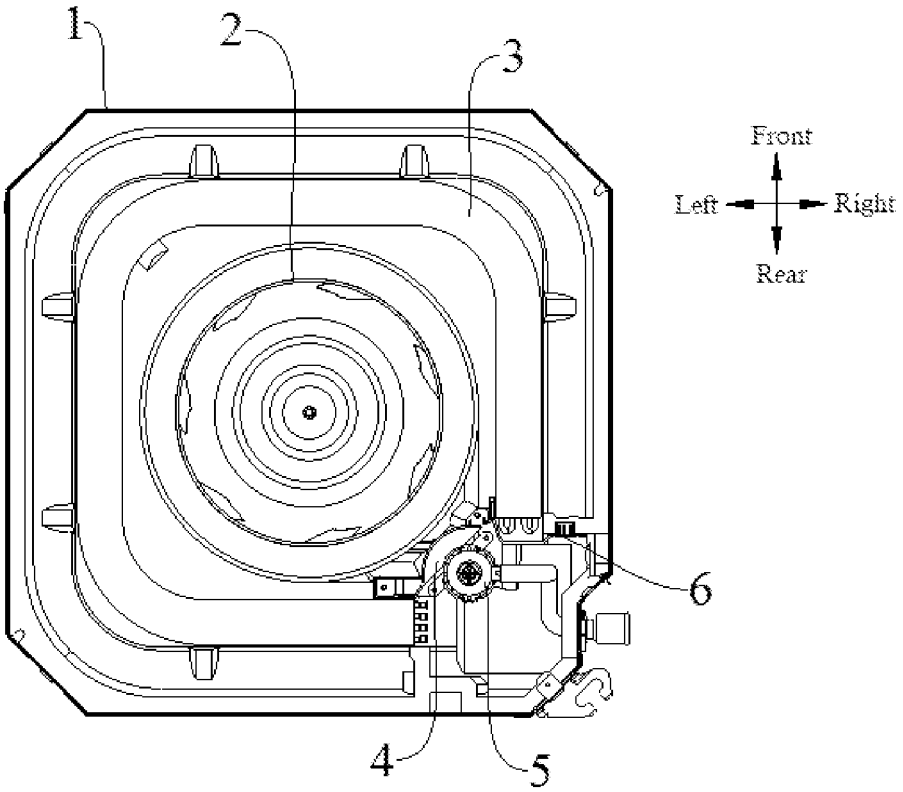
FIG. 1 is a schematic view of an overall structure of an indoor unit according to an embodiment of the present disclosure.

REFERENCES SIGNS casing 1;
air guiding ring 2;
heat exchanger 3;
sealing plate 4; first plate body 41; second plate body 42; first connecting portion 411; second connecting portion 412; first chassis fixing portion 413; second chassis fixing portion 414; water pump mounting plate 415; first lug plate 416; second lug plate 417; support plate 418; water level switch mounting plate 419; long groove 420; protruding portion 421; wire hole 422;
water pump 5;
water level switch 6.

DETAILED DESCRIPTION

Embodiments of the present disclosure will be described in detail below, and examples of the embodiments will be shown in the accompanying drawings. The embodiments described below are exemplary and are intended to explain the present disclosure rather than limit the present disclosure.

The present disclosure is based on the inventor's discovery and knowledge of the following facts and issues.

In the related art, an indoor unit of an air conditioner such as a central air conditioner typically includes a casing, an air guiding ring, a heat exchanger, a motor and other components. In order to mount these components, it is usually necessary to provide independent connection parts, mounting seats and other structural parts inside the casing, which makes the internal structure of the indoor unit complex, inconvenient to disassembly and assembly, and is not conducive to rapid anomaly check and troubleshooting, thus reducing the anomaly handling efficiency.

The indoor unit according to embodiments of the present disclosure includes a casing 1, an air guiding ring 2, a heat exchanger 3, a sealing plate 4, and a water pump 5.

As shown in FIG. 1, the casing 1 is roughly a square shell, and the casing 1 may be formed by sheet metal stamping or welding.

The air guiding ring 2 is arranged inside the casing 1, and as shown in FIG. 1, the air guiding ring 2 is fixed in a center position of the casing 1. The air guiding ring 2 is directly corresponding to a fan wheel and is used in conjunction with the fan wheel, to guide airflow.

The heat exchanger 3 has a first end and a second end, and the heat exchanger 3 is arranged in the casing 1 and surrounds the air guiding ring 2. Specifically, as shown in FIG. 1, the heat exchanger 3 is mounted in the casing 1, the heat exchanger 3 is generally G-shaped and surrounds a peripheral side of the air guiding ring 2, and the first end and the second end of the heat exchanger 3 are two free ends of the heat exchanger 3.

The sealing plate 4 is arranged in the casing 1. The sealing plate 4 has a first connecting portion 411, a second connecting portion 412 and a water pump mounting portion. The first connecting portion 411 and the second connecting portion 412 are connected with the heat exchanger 3, so that the sealing plate 4 seals a gap between the first end and the second end of the heat exchanger 3.

Specifically, as shown in FIG. 1, the sealing plate 4 is arranged in the casing 1, and the sealing plate 4 is integrated with the first connecting portion 411, the second connecting portion 412 and the water pump mounting portion, wherein the first connecting portion 411 is connected with the first end of the heat exchanger 3, and the second connecting portion 412 is connected with the second end of heat exchanger 3. As a result, the heat exchanger 3 and the sealing plate 4 overall form an annular closed structure, and the air guiding ring 2 is inside the annular closed structure.

The first connecting portion 411 and the second connecting portion 412 may be connecting lugs, snap slots or other structures, and detachable connection between the sealing plate 4 and the heat exchanger 3 can be achieved through the first connecting portion 411 and the second connecting portion 412.

It should be noted that the sealing plate 4 has an inner side and an outer side, wherein one side of the sealing plate 4 facing the air guiding ring 2 is the inner side, and the other side of the sealing plate 4 deviating from the air guiding ring 2 is the outer side. The water pump mounting portion is on an outer side surface of the sealing plate 4.

The water pump 5 is mounted on the water pump mounting portion. Specifically, as shown in FIG. 1, the water pump 5 may be detachably mounted on the water pump mounting portion, and for example, the water pump 5 is detachably mounted on the water pump mounting portion by screws. The water pump 5 is on the outer side of the sealing plate 4, and the sealing plate 4 is between the air guiding ring 2 and the water pump 5.

For the indoor unit according to embodiments of the present disclosure, since the water pump mounting portion is integrated on the sealing plate 4, a situation that the water pump 5 is mounted and fixed through independent structural parts in the related art is avoided, the integration, modularization and compactness of the structure inside the casing 1 is realized, and the structure inside the casing 1 is simplified, thus facilitating the rapid anomaly check and troubleshooting of indoor unit and improving the anomaly handling efficiency. In addition, since the water pump 5 may be integrated on the sealing plate 4, during installation of the water pump 5, the water pump 5 is first fixed on the sealing plate 4, and then the sealing plate 4 is fixed in the casing 1, to realize the installation and positioning of the water pump 5. Consequently, a situation that the casing 1 needs to be flipped during the installation of the water pump 5 and other components is avoided, and the assembly efficiency is improved.

In some embodiments, the indoor unit also includes a water level switch 6, the sealing plate 4 has a water level switch mounting portion, and the water level switch 6 is mounted on the water level switch mounting portion. Specifically, as shown in FIG. 1, the water level switch mounting portion is on the outer side surface of the sealing plate 4, and the water level switch 6 may be detachably mounted on the water level switch mounting portion. For example, the water level switch 6 is detachably connected to the sealing plate 4 by screws or snaps. The water level switch mounting portion enables the integration of the water level switch 6 and the sealing plate 4, which further decreases the number of structural parts inside the casing 1, facilitates the rapid anomaly check and troubleshooting of the indoor unit, and improves the anomaly handling efficiency.

Figure 3:
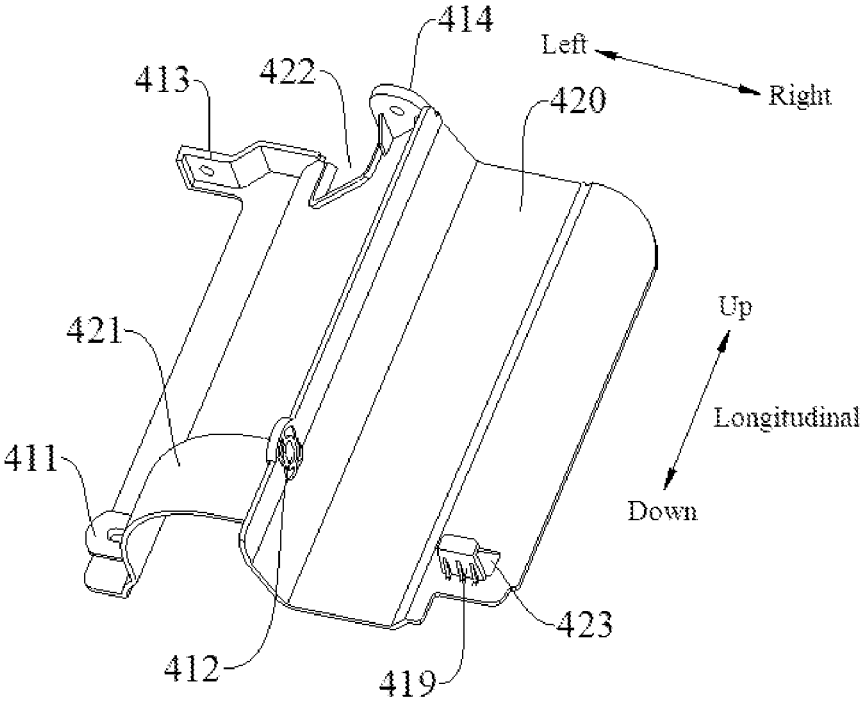
FIG. 3 is a first perspective view of the sealing plate in FIG. 1.

In some embodiments, the sealing plate 4 has a wire hole 422, and at least one of wires for a motor of the water pump 5, for the water level switch 6, and for a motor of the fan wheel is led to the outside of the casing 1 through the wire hole 422. Specifically, as shown in FIG. 3, the wire hole 422 is a through hole on the sealing plate 4 or a slot at an edge of the sealing plate 4. The wires inside and outside the sealing plate 4 may pass through the wire hole 422, sorting and arranging the wires. A need for additional wiring structures inside the casing 1 in the related art is eliminated, the structure inside the casing 1 is further simplified, and the assembly efficiency is improved.

It should be noted that the fan wheel may be on an inner side of the air guiding ring 2, and the motor of the fan wheel is on the inner side of the sealing plate 4 and is used to drive the fan wheel to rotate. The wire hole 422 facilitates the wire for the motor of the fan wheel to pass through the sealing plate 4.

Figure 2:
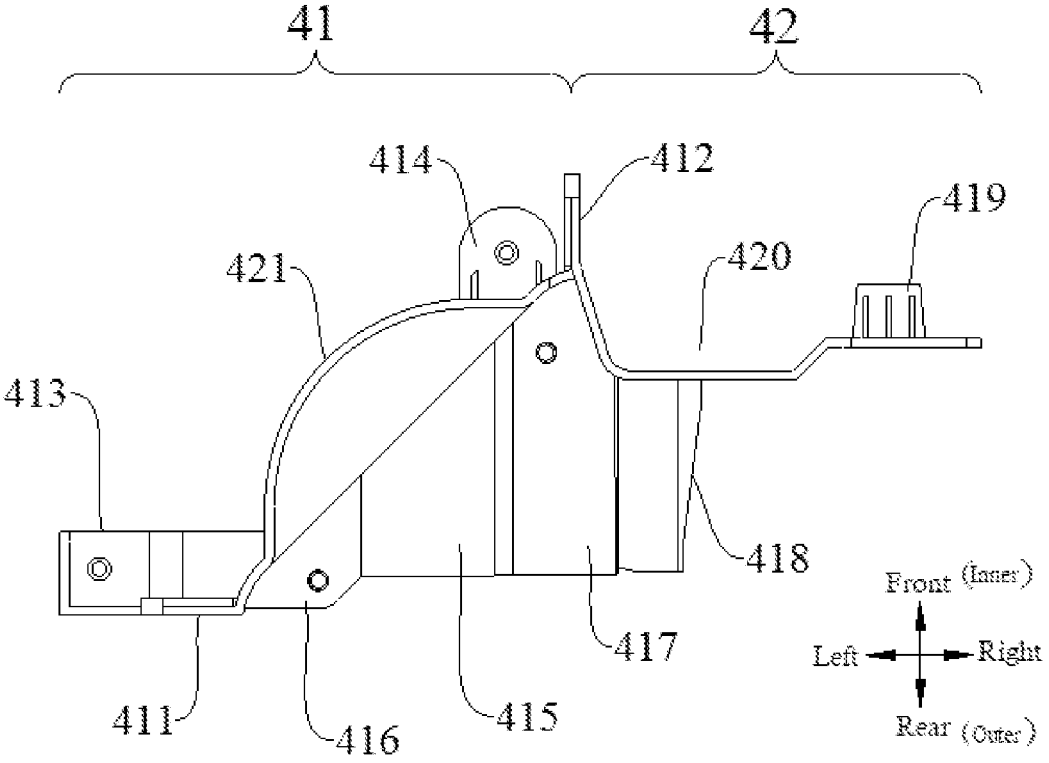
FIG. 2 is a bottom view of a sealing plate in FIG. 1.

In some embodiments, the indoor unit also includes a chassis, the sealing plate 4 also has a chassis fixing portion, and the chassis is connected to the chassis fixing portion. Specifically, as shown in FIG. 2 and FIG. 3, the chassis fixing portion is arranged at an upper end of the sealing plate 4. The chassis fixing portion is used for connection with the chassis of the indoor unit in a detachable manner, and for example, the chassis fixing portion may be connected to the chassis by screws or bolts. On the one hand, the arrangement of the chassis fixing portion further realizes the integration of the structural parts and the sealing plate 4, simplifying the structure and facilitating the anomaly check and handling. On the other hand, the arrangement of the chassis fixing portion realizes the connection and fixation between the sealing plate 4 and the chassis, making the installation of the sealing plate 4 more compact and the structure firmer, avoiding random shaking of the sealing plate 4 and reducing noise.

In some embodiments, the sealing plate 4 includes a first plate body 41 and a second plate body 42. The second plate body 42 is roughly L-shaped. A second longitudinal edge of the first plate body 41 is connected with a first longitudinal edge of the second plate body 42. The water pump mounting portion is arranged on an outer surface of the first plate body 41 deviating from the air guiding ring 2, and the water level switch 6 is arranged on an outer surface of the second plate body 42 deviating from the air guiding ring 2.

Specifically, as shown in FIG. 2, along a left-right direction, the sealing plate 4 includes the first plate body 41 and the second plate body 42, and the first plate body 41 is on a left side of the second plate body, wherein the first plate body 41 extends roughly along a direction from the rear left to the front right, and the second plate body 42 extends roughly along the left-right direction. Each of the first plate body 41 and the second plate body 42 has a first longitudinal edge and a second longitudinal edge, wherein the first longitudinal edge of the first plate body 41 is a left edge of the first plate body 41, the second longitudinal edge of the first plate body 41 is a right edge of the first plate body 41, the first longitudinal edge of the second plate body 42 is a left edge of the second plate body 42, and the second longitudinal edge of the second plate body 42 is a right edge of the second plate body 42.

The first plate body 41 and the second plate body 42 are at an angle, which is an obtuse angle. A side surface of the first plate body 41 facing the angle is the outer surface of the first plate body 41, and a side surface of the second plate body 42 facing the angle is the outer surface of the second plate body 42. The water pump mounting portion is arranged on the outer surface of the first plate body 41, and the water level switch 6 is mounted on the outer surface of the second plate body 42. That is, the water pump 5 and the water level switch 6 are both within the angle formed by the first plate body 41 and the second plate body 42.

As shown in FIG. 2, the second plate body 42 is roughly L-shaped, that is, most of the second plate body 42 extends along the left-right direction, and a part of the second plate body 42 extends along a front-rear direction (an inner-outer direction) and is on an inner side of the second plate body 42. Thus, the second connecting portion 412 may be on the part of the second plate body 42 extending along the front-rear direction, which facilitates the arrangement of the second connecting portion 412.

In some embodiments, the first connecting portion 411 is on the first longitudinal edge of the first plate body 41 and adjacent to a first end of the first plate body 41, and the first connecting portion 411 is connected to the first end of the heat exchanger 3. The second connecting portion 412 is on the first longitudinal edge of the second plate body 42 and adjacent to a first end of the second plate body 42, and the second connecting portion 412 is connected to the second end of the heat exchanger 3. The wire hole 422 is at a second end of the first plate body 41, and the chassis fixing portion is at the second end of the first plate body 41.

Specifically, as shown in FIG. 2 and FIG. 3, the first longitudinal edge of the first plate body 41 is the left edge of the first plate body 41, the first end of the first plate body 41 is a lower end of the first plate body 41, and the second end of the first plate body 41 is an upper end of the first plate body 41. As shown in FIG. 3, the first connecting portion 411 is on the left edge of the first plate body 41 and near the lower end of the first plate body 41.

The first longitudinal edge of the second plate body 42 is the left edge of the second plate body 42, the first end of the second plate body 42 is a lower end of the second plate body 42, a second end of the second plate body 42 is an upper end of the second plate body 42, and the second connecting portion 412 is on the left edge of the second plate body 42 and near the lower end of the second plate body 42. As shown in FIG. 3, the wire hole 422 is at the upper end of the first plate body 41, and the chassis fixing portion is also at the upper end of the first plate body 41. Consequently, the first connecting portion 411, the second connecting portion 412 and the chassis fixing portion may realize fixation of the upper and lower ends of the sealing plate 4 respectively, to ensure that all sides of the sealing plate 4 may be sealed and fitted with corresponding components, guarantee the sealing and fixing effect of the sealing plate 4, and avoid loosening of the sealing plate 4.

In some embodiments, the chassis fixing portion includes a first chassis fixing portion 413 and a second chassis fixing portion 414, and the wire hole 422 is between the first chassis fixing portion 413 and the second chassis fixing portion 414. Specifically, as shown in FIG. 3, the first chassis fixing portion 413 is on a left side of the upper end of the first plate body 41, and the second chassis fixing portion 414 is on a right side of the upper end of the first plate body 41. The wire hole 422 is at the upper end of the first plate body 41, and the wire hole 422 is in a position between the first chassis fixing portion 413 and the second chassis fixing portion 414. Thus, the fixation of the upper end of the first plate body 41 may be strengthened, ensuring that the sealing plates 4 on both sides of the wire hole 422 are in sealable connection with the chassis.

In some embodiments, the wire hole 422 is a groove with an opening and is at the second end of the first plate body 41. The first chassis fixing portion 413 is formed as an extension plate which is on an inner surface of the first plate body 41 and which has a first fixing hole. The second chassis fixing portion 414 is formed as a lug which is on the inner surface of the first plate body 41 and which has a second fixing hole. The first connecting portion 411 has a first connecting hole, and the second connecting portion 412 has a second connecting hole. A thickness of the first connecting portion 411 is greater than a thickness of the first plate body 41, and a thickness of the second connecting portion 412 is greater than a thickness of the second plate body 42.

Figure 4:
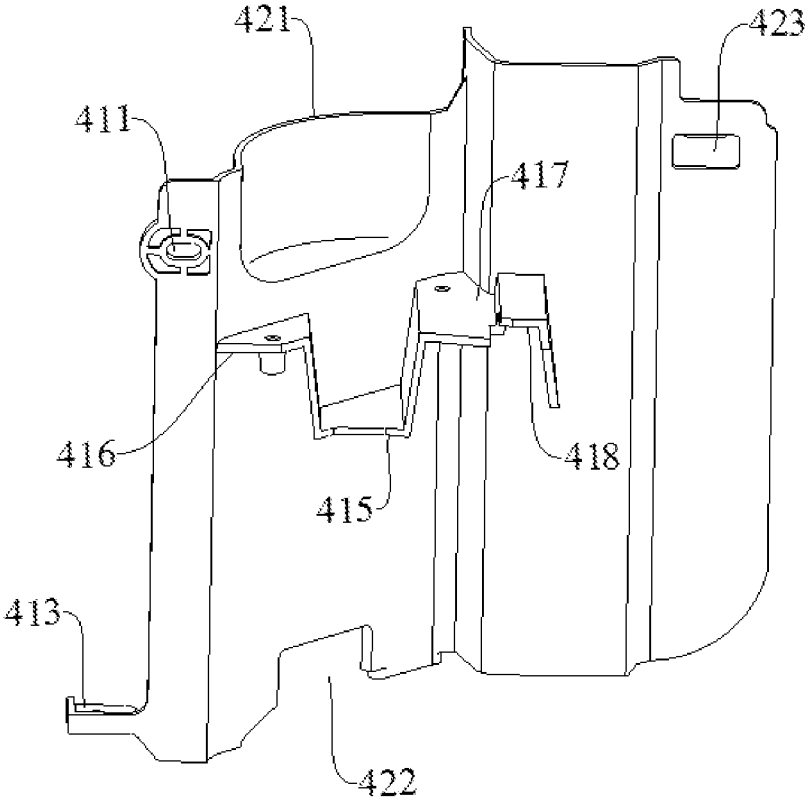
FIG. 4 is a second perspective view of the sealing plate in FIG. 1.
Figure 5:
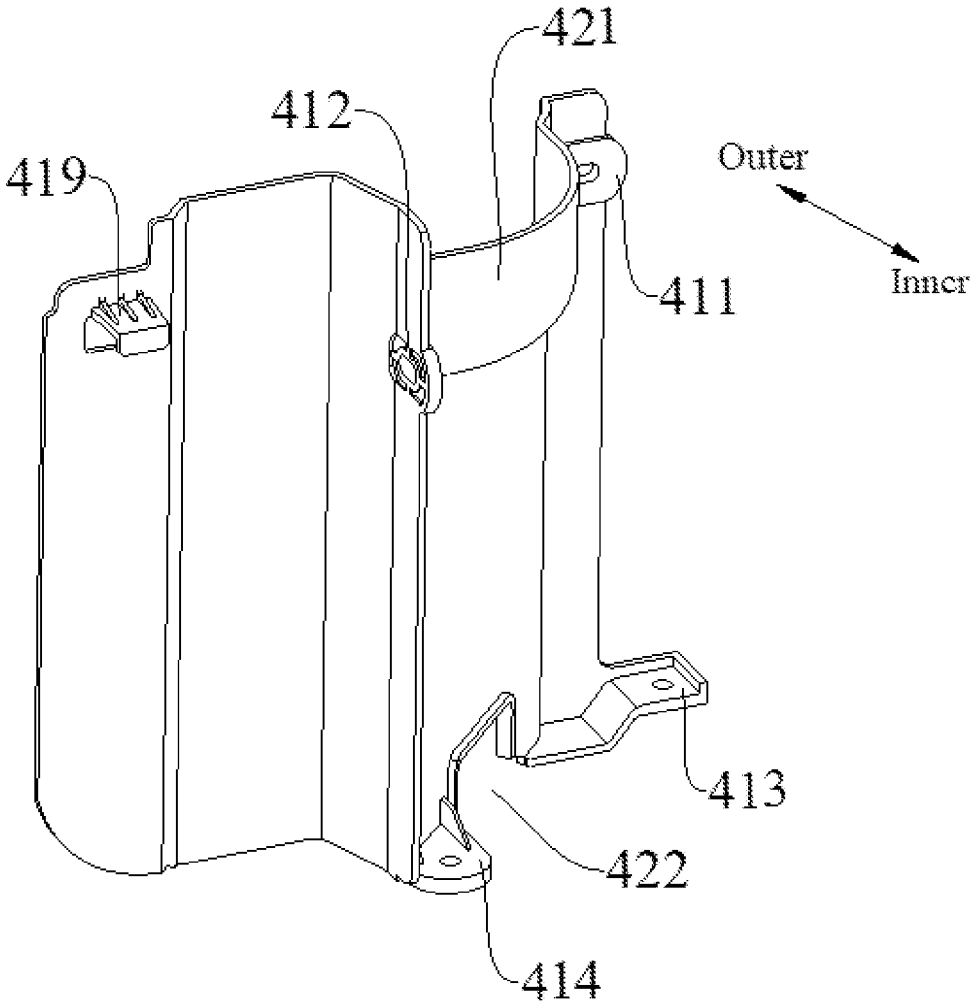
FIG. 5 is a third perspective view of the sealing plate in FIG. 1.

Specifically, as shown in FIG. 3 to FIG. 5, the wire hole 422 is at an edge of the upper end of the first plate body 41, the wire hole 422 is a U-shaped groove with an opening facing downwards, and the wire hole 422 runs through the first plate body 41 along the front-rear direction. The first chassis fixing portion 413 is arranged on the inner surface of the first plate body 41, and the first chassis fixing portion 413 may be an extension plate, which is roughly Z-shaped and extends roughly along the left-right direction. The second chassis fixing portion 414 is arranged on the inner surface of the first plate body 41, and the second chassis fixing portion 414 may be a lug and protrude to the inner side of the first plate body 41.

The first connecting portion 411 may have the first connecting hole, and the second connecting portion 412 may have the second connecting hole. The first connecting hole and the second connecting hole are used for screws or bolts to pass through, to realize the connection and fixation of the sealing plate 4. The thickness of the first connecting portion 411 and the thickness of the second connecting portion 412 are each larger than the thickness of the first plate body, thereby enhancing the structural strength of the first connecting portion 411 and the second connecting portion 412.

In some embodiments, the first connecting hole and the second connecting hole are waist-type holes, wherein the first connecting hole extends along the left-right direction, and the second connecting hole extends along the front-rear direction. Consequently, the assembly requirements for precision can be lowered and the assembly can be facilitated.

In some embodiments, as shown in FIG. 4, a plurality of reinforcing ribs are arranged around the first connecting hole and are arranged around the second connecting hole, and the plurality of reinforcing ribs are spaced apart along a circumferential direction of the first connecting hole or the second connecting hole. The reinforcing ribs may be processed and formed by cutting grooves on the first connecting portion 411 or the second connecting portion 412. Consequently, on the one hand, consumption of materials and hence costs may be reduced, and on the other hand, the structural strength of the first connecting portion 411 and the second connecting portion 412 may be guaranteed.

In some embodiments, the water pump mounting portion is formed as a water pump mounting plate 415, and the water pump mounting plate 415 is a roughly U-shaped with an opening facing the first end of the first plate body 41. An open end of the water pump mounting plate 415 is provided with a first lug plate 416 which extends from a first side wall of the water pump mounting plate 415 towards the first longitudinal edge of the first plate body 41 and is provided with a second lug plate 417 which extends from a second side wall of the water pump mounting plate 415 towards the second longitudinal edge of the first plate body 41. The first lug plate 416 has a third connecting hole, and the second lug plate 417 has a fourth connecting hole.

Specifically, as shown in FIG. 4, the water pump mounting plate 415 is roughly a U-shaped groove, and a groove opening of the water pump mounting plate 415 faces downwards. During the installation of the water pump 5, the water pump 5 may be inserted into the groove opening of the water pump mounting plate 415, achieving the effect of positioning and limiting the water pump 5 and facilitating the assembly of the water pump 5.

The water pump mounting portion also includes the first lug plate 416 and the second lug plate 417, wherein the first lug plate 416 is on a left side of the groove opening of the water pump mounting plate 415, and the second lug plate 417 is on a right side of the groove opening of the water pump mounting plate 415. The first lug plate 416 and the second lug plate 417 are roughly perpendicular to the first plate body 41. The first lug plate 416 has the third connecting hole for screws or bolts to pass through, and the second lug plate 417 has the fourth connection hole for screws or bolts to pass through. During the installation of the water pump 5, one part of the water pump 5 may be inserted into the groove formed by the water pump mounting plate 415, and the other part of the water pump 5 may be arranged on the first lug plate 416 and the second lug plate 417 and may be detachably connected and fixed with the first lug plate 416 and the second lug plate 417.

In some embodiments, the water pump mounting portion also includes a support plate 418. As shown in FIG. 4, the support plate 418 is L-shaped, one part of the support plate 418 generally extends along an up-down direction, and the other part of the support plate 418 generally extends along the left-right direction. The support plate 418 is fixed on the outer surface of the second plate body, and a left side of the support plate 418 is arranged on the second lug plate 417. Therefore, during the installation of the water pump 5, a part of a pipe of the water pump 5 may be hung on the support plate 418, making the installation of the water pump 5 more compact.

In some embodiments, a part of the first end of the first plate body 41 protrudes inward to form a protruding portion 421 on the inner surface of the first plate body 41 and form a step surface on the outer surface of the first plate body. The protruding portion 421 is arc-shaped, and the water pump mounting portion is between the protruding portion 421 and the second end of the first plate body 41.

Specifically, as shown in FIG. 3 and FIG. 4, the lower end of the first plate body 41 is provided with the protruding portion 421, the protruding portion 421 protrudes towards the inner side of the first plate body 41, and the protruding portion 421 may be processed by stamping. Consequently, at the protruding portion 421, the inner surface of the first plate body 41 protrudes towards the inner side, the outer surface of the first plate body 41 is recessed towards the inner side and forms a step surface, and the protruding portion 421 is at the lower end of the water pump mounting portion. When in use, the protruding portion 421 may be used in cooperation with the water pump mounting portion, that is, one part of the water pump 5 may be fixed on the water pump mounting portion, and the other part of the water pump 5 may be fitted at the step surface formed by the protruding portion 421, to ensure the compactness and structural strength of the water pump 5, and further guarantee the stability of the water pump 5 during operation.

In some embodiments, the water level switch mounting portion is formed as a water level switch hole 423 and a water level switch mounting plate 419. The water level switch mounting plate 419 is at a hole edge of the water level switch hole 423, and the water level switch mounting plate 419 is L-shaped and extends from the inner surface of the second plate body 42.

Specifically, as shown in FIG. 3, the water level mounting portion may be at the first end of the second plate body 42, and the water level switch mounting portion includes the water level switch hole 423 which may be a rectangular through hole and which runs through the second plate body 42 along the inner-outer direction. During installation of the water level switch 6, a part of the water level switch 6 may be fitted in the water level switch hole 423. For example, a part of the water level switch 6 may be in an interference fit with the water level switch hole 423, or may be in a snap fit with the water level switch hole 423 through a structure such as a snap.

The water level switch mounting plate 419 is arranged on the inner surface of the second plate body 42, and the water level switch mounting plate 419 is an L-shaped plate. One part of the water level switch mounting plate 419 extends along the inner-outer direction, and the other part of the water level switch mounting plate 419 extends along the up-down direction. The water level switch mounting plate 419 forms a structure similar to a snap and may be clamped and fixed with foam of the chassis.

In some embodiments, the first longitudinal edge of the first plate body 41 is formed as a flat plate abutting against the heat exchanger 3, and the first longitudinal edge of the second plate body 42 is formed as a flat plate abutting against the heat exchanger 3.

Specifically, as shown in FIG. 3, the first longitudinal edge of the first plate body 41 may be flat and extends along the left edge of the first plate body 41, and the first longitudinal edge of the second plate body 42 may be flat and extends along the left edge of the second plate body 42. The first connecting portion 411 may be arranged on the first longitudinal edge of the first plate body 41, and the second connecting portion 412 may be arranged on the first longitudinal edge of the second plate body 42. Thus, a contact area between the sealing plate 4 and the heat exchanger 3 may be increased, and the sealing effect may be ensured.

In some embodiments, as shown in FIG. 2 and FIG. 3, the inner surface of the second plate body 42 may be provided with a long groove 420, the long groove 420 extends along the up-down direction of the second plate body 42, and the long groove 420 may be processed and formed by stamping the second plate body 42. During the installation of the sealing plate 4, a part of the heat exchanger 3 may be fitted in the long groove 420, thereby enhancing the structural strength and adaptability of the sealing plate 4.

In some embodiments, a flange may be arranged at the wire hole 422 and extends along a hole edge of the wire hole 422, and an outer surface of the flange may be a circular arc surface. Consequently, on the one hand, a situation that the hole edge of the wire hole 422 is sharp and easy to scratch the wire may be avoided, and on the other hand, the structural strength of the wire hole 422 may be enhanced.

In some embodiments, the casing 1 has a roughly rectangular cross section, and the sealing plate 4 is at a corner inside the casing 1. Specifically, as shown in FIG. 1, the casing 1 may be square, and the sealing plate 4 may be at a right rear corner of the casing 1.

An air conditioner according to embodiments of the present disclosure is described below. The air conditioner according to embodiments of the present disclosure includes an indoor unit which may be the indoor unit described in the above embodiments. Specifically, the air conditioner may include an outdoor unit and a plurality of indoor units, and each indoor unit is internally provided with a chassis, an air guiding ring 2, a heat exchanger 3, a sealing plate 4, a water pump 5 and a water level switch 6, wherein the heat exchanger 3 and the sealing plate 4 can be mounted on the chassis. The sealing plate 4 is connected with the heat exchanger 3, the heat exchanger 3 and the sealing plate 4 together form a ring, and the air guiding ring 2 is fixed in a middle position of the heat exchanger 3 and the sealing plate 4. The sealing plate 4 is provided with a water pump mounting portion and a water level switch mounting portion. The water pump 5 is mounted in the water pump mounting portion, and the water level switch 6 is mounted in the water level switch mounting portion. The air guiding ring 2 is on one side of the sealing plate 4, while the water pump 5 and the water level switch 6 are located on the other side of the sealing plate 4.

In some embodiments, the indoor unit also includes a water receiving pan. The air guiding ring 2 may be embedded in the water receiving pan, or may be integrated with the water receiving pan. The heat exchanger 3 is on the water receiving pan.

A sealing plate 4 for a heat exchanger 3 of an air conditioner according to embodiments of the present disclosure is described below.

Regarding the sealing plate 4 for the heat exchanger 3 of the air conditioner according to embodiments of the present disclosure, the sealing plate 4 has a first connecting portion 411 suitable for connection with the heat exchanger 3, a second connecting portion 412 suitable for connection with the heat exchanger 3, and a water pump mounting portion suitable for installation of a water pump 5.

The sealing plate 4 for the heat exchanger 3 of the air conditioner according to embodiments of the present disclosure realize the integration and modularization of the water pump mounting portion and the sealing plate 4, simplifying the structure and facilitating the anomaly check and handling.

In some embodiments, the sealing plate 4 also has a water level switch mounting portion suitable for installation of a water level switch 6. It should be noted that the water pump mounting portion and the water level switch mounting portion may be integrated with the sealing plate 4, or may be fixed on the sealing plate 4 by screws, welding, etc.

As shown in FIGS. 3 to 5, the sealing plate 4 also has a wire hole 422 suitable for passage of at least one of wires for a motor of the water pump, the water level switch, and a motor of the fan wheel. The wire hole 422 facilitates passage of the wires on both sides of the sealing plate 4 and the sorting of the wires.

As shown in FIG. 3, the sealing plate 4 also has a chassis fixing portion suitable for fixation of a chassis. The chassis fixing portion includes a first chassis fixing portion 413 and a second chassis fixing portion 414, and the wire hole 422 is between the first chassis fixing portion 413 and the second chassis fixing portion 414.

As shown in FIG. 2, the sealing plate 4 includes a first plate body 41 and a second plate body 42. The second plate body 42 is roughly L-shaped. A second longitudinal edge of the first plate body 41 is connected with a first longitudinal edge of the second plate body 42, the water pump mounting portion is arranged on an outer surface of the first plate body 41 deviating from the air guide ring 2, and the water level switch 6 is arranged on an outer surface of the second plate body 42 deviating from the air guide ring 2. The first connecting portion 411 is on the first longitudinal edge of the first plate body 41 and adjacent to a first end of the first plate body 41, and the first connecting portion 411 is connected with a first end of the heat exchanger 3. The second connecting portion 412 is on the first longitudinal edge of the second plate body 42 and adjacent to a first end of the second plate body 42, and the second connecting portion 412 is connected with a second end of the heat exchanger 3. The wire hole 422 is at a second end of the first plate body 41, and the chassis fixing portion is at the second end of the first plate body 41.

As shown in FIG. 3, the wire hole 422 is a groove with an opening and is at the second end of the first plate body 41. The first chassis fixing portion 413 is formed as an extension plate which is on an inner surface of the first plate body 41 and which has a first fixing hole. The second chassis fixing portion 414 is formed as a lug which is on the inner surface of the first plate body 41 and which has a second fixing hole. The first connecting portion 411 has a first connecting hole, and the second connecting portion 412 has a second connecting hole. A thickness of the first connecting portion 411 is greater than a thickness of the first plate body 41, and a thickness of the second connecting portion 412 is greater than a thickness of the second plate body 42.

As shown in FIG. 4, the water pump mounting portion is formed as a water pump mounting plate 415, and the water pump mounting plate 415 is a roughly U-shaped with an opening facing the first end of the first plate body 41. An open end of the water pump mounting plate 415 is provided with a first lug plate 416 which extends from a first side wall of the water pump mounting plate 415 towards the first longitudinal edge of the first plate body 41 and is provided with a second lug plate 417 which extends from a second side wall of the water pump mounting plate 415 towards the second longitudinal edge of the first plate body 41. The first lug plate 416 has a third connecting hole, and the second lug plate 417 has a fourth connecting hole.

As shown in FIGS. 3 and 4, a part of the first end of the first plate body 41 protrudes inward to form a protruding portion 421 on the inner surface of the first plate body 41 and form a step surface on the outer surface of the first plate body. The protruding portion 421 is arc-shaped, and the water pump mounting portion is between the protruding portion 421 and the second end of the first plate body 41. The water level switch mounting portion is formed as a water level switch hole 423 and a water level switch mounting plate 419. The water level switch mounting plate 419 is at a hole edge of the water level switch hole 423. The water level switch mounting plate 419 is L-shaped and extends from the inner surface of the second plate body 42.

As shown in FIG. 3 and FIG. 5, the first longitudinal edge of the first plate body 41 is formed as a flat plate abutting against the heat exchanger 3, and the first longitudinal edge of the second plate body 42 is formed as a flat plate abutting against the heat exchanger 3.

In the description of the present disclosure, it should be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner connection or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Further, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described connected to the embodiment or example is included in at least one embodiment or example of the present disclosure. Thus, the above terms throughout this specification are not necessarily referring to the same embodiment or example of the present disclosure. Further, the particular features, structures, materials, or characteristics may be combined in any suitable manner in one or more embodiments or examples. Moreover, those skilled in the art can integrate and combine the different embodiments or examples and the features of the different embodiments or examples described in this specification without contradicting each other. Although embodiments of the present disclosure have been shown and described, it can be appreciated by those skilled in the art that the above embodiments are merely exemplary and are not intended to limit the present disclosure, and various changes, modifications, alternatives and variations may be made to the embodiments within the scope of the present disclosure.

What is claimed is:

1. An indoor unit comprising:

a casing;

an air guiding ring arranged inside the casing;

a heat exchanger having a first end and a second end, the heat exchanger being arranged inside the casing and surrounding the air guiding ring;

a sealing plate arranged inside the casing and having a first connecting portion, a second connecting portion and a water pump mounting portion, the first connecting portion and the second connecting portion being connected with the heat exchanger to allow the sealing plate to seal a gap between the first end and the second end of the heat exchanger; and a water pump mounted on the water pump mounting portion.

2. The indoor unit according to claim 1, further comprising a water level switch, wherein the sealing plate has a water level switch mounting portion, and the water level switch is mounted on the water level switch mounting portion.

3. The indoor unit according to claim 2, wherein the sealing plate has a wire hole, and at least one of wires for a motor of the water pump, for the water level switch, and for a motor of a fan wheel is led to outside of the casing through the wire hole.

4. The indoor unit according to claim 1, wherein the casing has a substantially rectangular cross section, and the sealing plate is at a corner inside the casing.

5. An air conditioner, comprising the indoor unit according to claim 1.

6. The indoor unit according to claim 3, further comprising a chassis, wherein the sealing plate also has a chassis fixing portion, and the chassis is connected to the chassis fixing portion.

7. The indoor unit according to claim 6, wherein:

the sealing plate comprises a first plate body and a second plate body, the second plate body being roughly L-shaped, a second longitudinal edge of the first plate body is connected with a first longitudinal edge of the second plate body, and the water pump mounting portion is on an outer surface of the first plate body deviating from the air guiding ring, and the water level switch is on an outer surface of the second plate body deviating from the air guiding ring.

8. The indoor unit according to claim 7, wherein:

the first connecting portion is on a first longitudinal edge of the first plate body and adjacent to a first end of the first plate body, and the first connecting portion is connected to the first end of the heat exchanger, the second connecting portion is on the first longitudinal edge of the second plate body and adjacent to a first end of the second plate body, and the second connecting portion is connected to the second end of the heat exchanger, and the wire hole is at a second end of the first plate body, and the chassis fixing portion is at the second end of the first plate body.

9. The indoor unit according to claim 8, wherein the chassis fixing portion comprises a first chassis fixing portion and a second chassis fixing portion, and the wire hole is between the first chassis fixing portion and the second chassis fixing portion.

10. The indoor unit according to claim 9, wherein:

the wire hole is a groove with an opening and is at the second end of the first plate body, the first chassis fixing portion is formed as an extension plate, the extension plate being on an inner surface of the first plate body and having a first fixing hole, and the second chassis fixing portion is formed as a lug, the lug being on the inner surface of the first plate body and having a second fixing hole, and the first connecting portion has a first connecting hole, and the second connecting portion has a second connecting hole, a thickness of the first connecting portion being greater than a thickness of the first plate body, and a thickness of the second connecting portion being greater than the thickness of a second plate body.

11. The indoor unit according to claim 7, wherein:

the water pump mounting portion is formed as a water pump mounting plate, and the water pump mounting plate is a roughly U-shaped with an opening facing towards a first end of the first plate body, an open end of the water pump mounting plate is provided with a first lug plate extending from a first side wall of the water pump mounting plate towards a first longitudinal edge of the first plate body and is provided with a second lug plate extending from a second side wall of the water pump mounting plate towards the second longitudinal edge of the first plate body, and the first lug plate has a third connecting hole, and the second lug plate has a fourth connecting hole.

12. The indoor unit according to claim 11, wherein a part of the first end of the first plate body protrudes inward to form a protruding portion on an inner surface of the first plate body and form a step surface on the outer surface of the first plate body, the protruding portion is arc-shaped, and the water pump mounting portion is between the protruding portion and a second end of the first plate body.

13. The indoor unit according to claim 11, wherein the water level switch mounting portion is formed as a water level switch hole and a water level switch mounting plate, the water level switch mounting plate is arranged on a hole edge of the water level switch hole, and the water level switch mounting plate is L-shaped and extends from an inner surface of the second plate body.

14. The indoor unit according to claim 7, wherein a first longitudinal edge of the first plate body is formed as a flat plate abutting against the heat exchanger, and the first longitudinal edge of the second plate body is formed as a flat plate abutting against the heat exchanger.

15. A sealing plate for a heat exchanger of an air conditioner, the heat exchanger having a first end and a second end, the heat exchanger being arranged inside a casing and surrounding an air guiding ring arranged inside the casing, the sealing plate comprising:

a first connecting portion connected with the heat exchanger, and a second connecting portion connected with the heat exchanger, to allow the sealing plate to seal a gap between the first end and the second end of the heat exchanger; and a water pump mounting portion configured for a water pump to be mounted thereon.

16. The sealing plate according to claim 15, wherein the sealing plate further comprises a water level switch mounting portion for installation of a water level switch.

17. The sealing plate according to claim 16, wherein the sealing plate further has a wire hole to allow at least one of wires for a motor of the water pump, for the water level switch, and for a motor of a fan wheel to pass through.

18. The sealing plate according to claim 17, wherein the sealing plate further comprises a chassis fixing portion for fixation of a chassis.

19. The sealing plate according to claim 18, wherein:

the sealing plate comprises a first plate body and a second plate body, the second plate body being roughly L-shaped, a second longitudinal edge of the first plate body is connected with a first longitudinal edge of the second plate body, the water pump mounting portion is on an outer surface of the first plate body deviating from an air guiding ring, and the water level switch is on an outer surface of the second plate body deviating from the air guiding ring, the first connecting portion is on a first longitudinal edge of the first plate body and adjacent to a first end of the first plate body, and the first connecting portion is connected to the first end of the heat exchanger, the second connecting portion is on the first longitudinal edge of the second plate body and adjacent to a first end of the second plate body, and the second connecting portion is connected to the second end of the heat exchanger, and the wire hole is at a second end of the first plate body, and the chassis fixing portion is at the second end of the first plate body.

20. The sealing plate according to claim 19, wherein the first longitudinal edge of the first plate body is formed as a flat plate abutting against the heat exchanger, and the first longitudinal edge of the second plate body is formed as a flat plate abutting against the heat exchanger.

21. The sealing plate according to claim 19, wherein the chassis fixing portion comprises a first chassis fixing portion and a second chassis fixing portion, and the wire hole is between the first chassis fixing portion and the second chassis fixing portion.

22. The sealing plate according to claim 21, wherein:

the wire hole is a groove with an opening and is at the second end of the first plate body, the first chassis fixing portion is formed as an extension plate, the extension plate being on an inner surface of the first plate body and having a first fixing hole, and the second chassis fixing portion is formed as a lug, the lug being on the inner surface of the first plate body and having a second fixing hole, and the first connecting portion has a first connecting hole, and the second connecting portion has a second connecting hole, a thickness of the first connecting portion being greater than a thickness of the first plate body, and a thickness of the second connecting portion being greater than the thickness of a second plate body.

23. The sealing plate according to claim 19, wherein:

the water pump mounting portion is formed as a water pump mounting plate, and the water pump mounting plate is a roughly U-shaped with an opening facing towards a first end of the first plate body, an open end of the water pump mounting plate is provided with a first lug plate extending from a first side wall of the water pump mounting plate towards the first longitudinal edge of the first plate body and is provided with a second lug plate extending from a second side wall of the water pump mounting plate towards the second longitudinal edge of the first plate body, and the first lug plate has a third connecting hole, and the second lug plate has a fourth connecting hole.

24. The sealing plate according to claim 23, wherein:

a part of the first end of the first plate body protrudes inward to form a protruding portion on an inner surface of the first plate body and form a step surface on the outer surface of the first plate body, the protruding portion is arc-shaped, and the water pump mounting portion is between the protruding portion and a second end of the first plate body, and the water level switch mounting portion is formed as a water level switch hole and a water level switch mounting plate, the water level switch mounting plate is arranged on a hole edge of the water level switch hole, and the water level switch mounting plate is L-shaped and extends from an inner surface of the second plate body.

* * * * *